US007140192B2

(12) United States Patent
Allen et al.

(10) Patent No.: US 7,140,192 B2
(45) Date of Patent: Nov. 28, 2006

(54) COVER FOR AN AIR CONDITIONING SYSTEM AND METHODS

(75) Inventors: Kendall E. Allen, Ruther Glen, VA (US); Ralph G. Bailey, Richmond, VA (US); Lisa Hughey, Mechanicsville, VA (US)

(73) Assignee: Dometic Environmental Corporation, Pompano Beach, FL (US)

( * ) Notice: Subject to any disclaimer, the term of this patent is extended or adjusted under 35 U.S.C. 154(b) by 242 days.

(21) Appl. No.: 10/961,334

(22) Filed: Oct. 8, 2004

(65) Prior Publication Data

US 2005/0198985 A1 Sep. 15, 2005

Related U.S. Application Data

(60) Provisional application No. 60/551,819, filed on Mar. 10, 2004.

(51) Int. Cl.
*B60H 1/32* (2006.01)

(52) U.S. Cl. ..... 62/244; 62/259.1; 454/87

(58) Field of Classification Search ..... 62/239, 62/244, 259.1, 263, 298, 454, 455; 165/42, 165/43; 454/87, 139, 201
See application file for complete search history.

(56) References Cited

U.S. PATENT DOCUMENTS

| | | | | | |
|---|---|---|---|---|---|
| D211,020 | S | | 5/1968 | Jakus et al. | |
| D221,550 | S | | 8/1971 | Dixon | |
| D221,551 | S | | 8/1971 | Dixon | |
| D266,870 | S | * | 11/1982 | Allard et al. | 62/244 |
| 4,672,818 | A | * | 6/1987 | Roth | 62/239 |
| 4,756,359 | A | | 7/1988 | Greer | |
| 4,762,170 | A | | 8/1988 | Nijjar et al. | |
| 4,825,663 | A | | 5/1989 | Nijjar et al. | |
| D309,345 | S | * | 7/1990 | Anderson et al. | 62/239 |
| 4,956,978 | A | * | 9/1990 | Bleck et al. | 62/239 |
| D311,244 | S | | 10/1990 | Allard et al. | |
| D318,107 | S | * | 7/1991 | Allard et al. | 62/239 |
| D323,552 | S | * | 1/1992 | Baldwin et al. | 296/36 |
| 5,238,282 | A | * | 8/1993 | Watson et al. | 296/24.41 |
| D360,681 | S | | 7/1995 | Chopko et al. | |
| 5,438,842 | A | * | 8/1995 | Watkins et al. | 62/89 |
| D367,524 | S | * | 2/1996 | Waldschmidt et al. | 454/136 |
| 5,934,092 | A | * | 8/1999 | Krompass et al. | 62/199 |
| D417,724 | S | * | 12/1999 | Okamoto et al. | 62/259.1 |

(Continued)

FOREIGN PATENT DOCUMENTS

JP 2002-2413 A * 1/2002

*Primary Examiner*—Mohammad M. Ali
(74) *Attorney, Agent, or Firm*—Pearne & Gordon LLP

(57) ABSTRACT

A cover for an air conditioning system includes a fluid inlet port adapted to permit fluid located outside the interior space to enter through a wall of the cover and into a first interior space portion of the cover. The cover further includes a fluid outlet port adapted to permit fluid located inside the second interior space portion to exit through the wall to a location outside the interior space. The cover may be integrated as part of a vehicle wherein a fluid inlet port of the cover can be placed in fluid communication with an air inlet of a first evaporator fan and an air inlet of a second evaporator fan and a fluid outlet port of the cover can be placed in fluid communication with an air outlet of the second evaporator fan. Methods also include retrofitting a vehicle comprising the steps of removing a first cover from a support surface and mounting a second cover to the support surface.

14 Claims, 5 Drawing Sheets

U.S. PATENT DOCUMENTS

| | | | | |
|---|---|---|---|---|
| D419,229 | S * | 1/2000 | Stevens et al. | 62/239 |
| D424,184 | S | 5/2000 | Chang-Kwon | |
| 6,116,037 | A | 9/2000 | Burnett | |
| 6,238,023 | B1 * | 5/2001 | Choi | 312/101 |
| 6,357,248 | B1 | 3/2002 | Bongaards et al. | |
| D455,825 | S | 4/2002 | Moretti et al. | |
| D460,165 | S | 7/2002 | Hanson et al. | |
| 6,453,678 | B1 | 9/2002 | Sundhar | |
| 6,470,960 | B1 | 10/2002 | Kampf et al. | |
| 6,681,588 | B1 | 1/2004 | Zeigler | |
| 2001/0032476 | A1 | 10/2001 | Kampf et al. | |
| 2002/0056993 | A1 | 5/2002 | Kennedy | |
| 2003/0209021 | A1 | 11/2003 | Zeigler | |
| 2004/0035112 | A1 | 2/2004 | Bhabra | |

* cited by examiner

COVER FOR AN AIR CONDITIONING SYSTEM AND METHODS

CROSS-REFERENCE TO RELATED APPLICATIONS

This application claims the benefit of U.S. Provisional Application No. 60/551,819 filed on Mar. 10, 2004, which is herein entirely incorporated by reference.

FIELD OF THE INVENTION

The present invention is directed in general to a cover for an air conditioning system, and is more particularly directed to a cover for an air conditioner that is adapted to accommodate a first and second air conditioning system.

BACKGROUND OF THE INVENTION

Conventional trucks frequently include a driver cab with a driver compartment and a sleeper cab with a sleeper compartment. It is also known to provide an air conditioning system that directs conditioned air into the driver compartment. The conventional air conditioning system is adapted to draw a return air stream from the sleeper compartment of the truck. FIGS. 1–3 depict a conventional cover 10 typically used in the sleeper compartment that is adapted to provide an inlet port for the return air stream. The cover 10 comprises a body 12 including a wall 14 defining an undivided interior space 16. The wall 14 includes a peripheral edge 18 defining an opening 20 to the undivided interior space 16.

The cover 10 is adapted to be mounted to a mounting surface 32 including an opening 34 to facilitate communication with the return air stream of the air conditioning system in use. Since the interior space 16 is undivided, the cover 10 may be located in a variety of positions relative to the support surface 32 so long as the footprint defined by the peripheral edge 18 is located over the mounting surface opening 34.

The conventional cover 10 also includes a first storage pocket 22 and a second storage pocket 28 that may be used to store miscellaneous items. As further illustrated in FIGS. 2 and 3, the first storage pocket 22 includes an electrical socket 24 that includes electrical wires 26 adapted to be threaded through the support surface opening 34 for connection to a power source. The conventional cover 20 includes a fluid inlet port 30 but provides no provision for a fluid outlet port. It would be desirable to provide an improved cover including both fluid inlet and fluid outlet ports to provide a return air intake as well as an outlet port for conditioned air.

Moreover, the vehicle may not be configured to readily provide heating, ventilating, and air conditioning (HVAC) when parked. Specifically, it is to be appreciated that such vehicles may not provide for a desired air handling (e.g., air conditioning) of the sleeper compartment when the vehicles are not being driven. For example, if the vehicle is parked and conditioned air is desired, the engine of the vehicle, which drives the associated engine driven air-conditioning unit, may need to be operated. Therefore, powering the air conditioner with an engine can result in air pollution, sound pollution, and engine wear concerns. As such, there is a need to address issues concerning air conditioning which can be used when the vehicle is stationary.

SUMMARY OF THE INVENTION

In accordance with one aspect, the present invention provides a cover for an air conditioning system. The cover includes a body with a wall defining an interior space. The wall includes a peripheral edge defining an opening to the interior space. The cover further includes a divider separating the interior space into a first interior space portion and a second interior space portion and separating the opening into a first area in communication with the first interior space portion and a second area in communication with the second interior space portion. The divider includes a divider edge, wherein the divider edge and a first portion of the peripheral edge define the first area of the opening and the divider edge and a second portion of the peripheral edge define the second area of the opening. The divider edge and the first and second portions of the peripheral edge are adapted to substantially extend adjacent a substantially planar mounting surface. The cover further includes a fluid inlet port in fluid communication with the first interior space portion and adapted to permit fluid located outside the interior space to enter through the wall and into the first interior space portion. The cover further includes a fluid outlet port in fluid communication with the second interior space portion and adapted to permit fluid located inside the second interior space portion to exit through the wall to a location outside the interior space.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DETAILED DESCRIPTION OF EXAMPLE EMBODIMENTS

Figure 1:
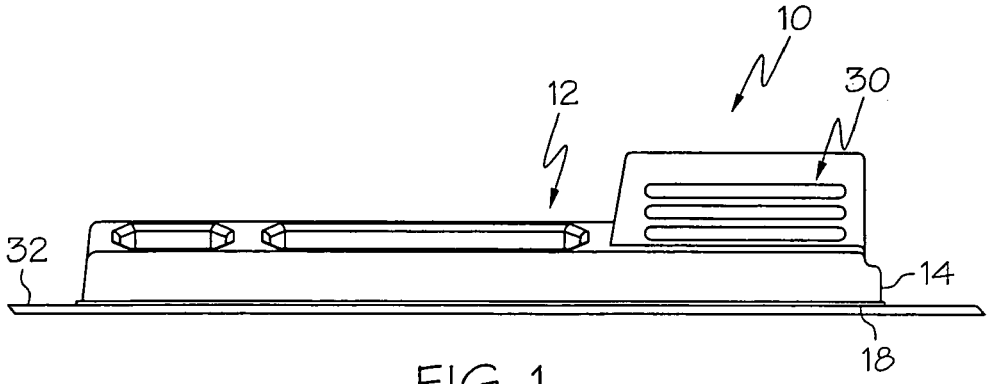
FIG. 1 (PRIOR ART)
FIG. 1 is a front elevational view of a conventional cover.
Figure 2:
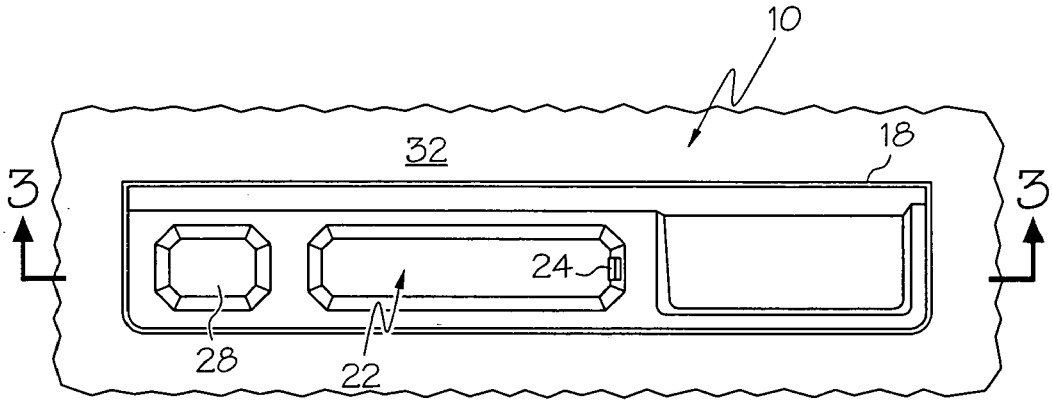
FIG. 2 (PRIOR ART)
FIG. 2 is a top plan view of the conventional cover of FIG. 1.
Figure 3:
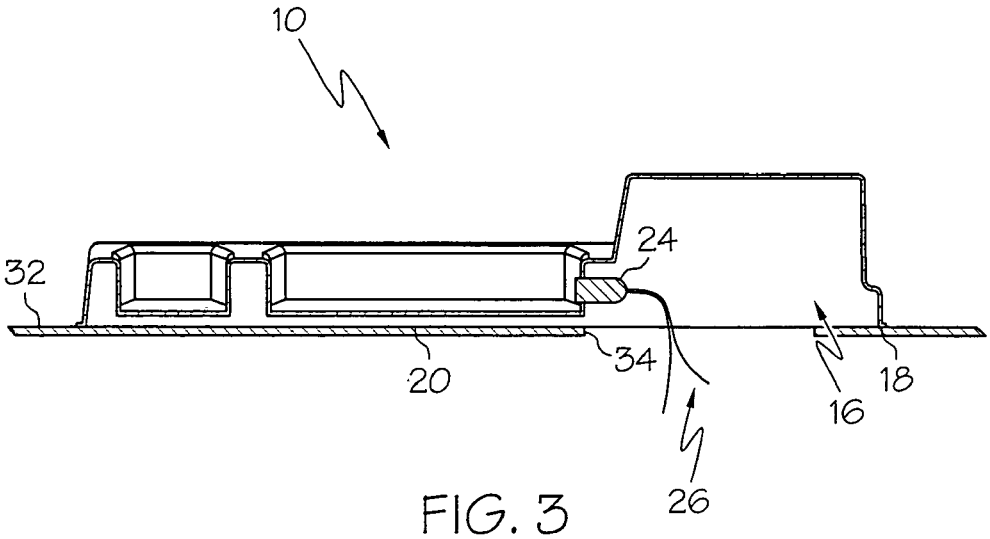
FIG. 3 (PRIOR ART)
FIG. 3 is a sectional view of the conventional cover along line 3—3 of FIG. 2.

Certain terminology is used herein for convenience only and is not to be taken as a limitation on the present invention. Further, in the drawings, the same reference numerals are employed for designating the same elements, and in order to clearly and concisely illustrate the present invention, certain features may be shown in somewhat schematic form.

Figure 4:
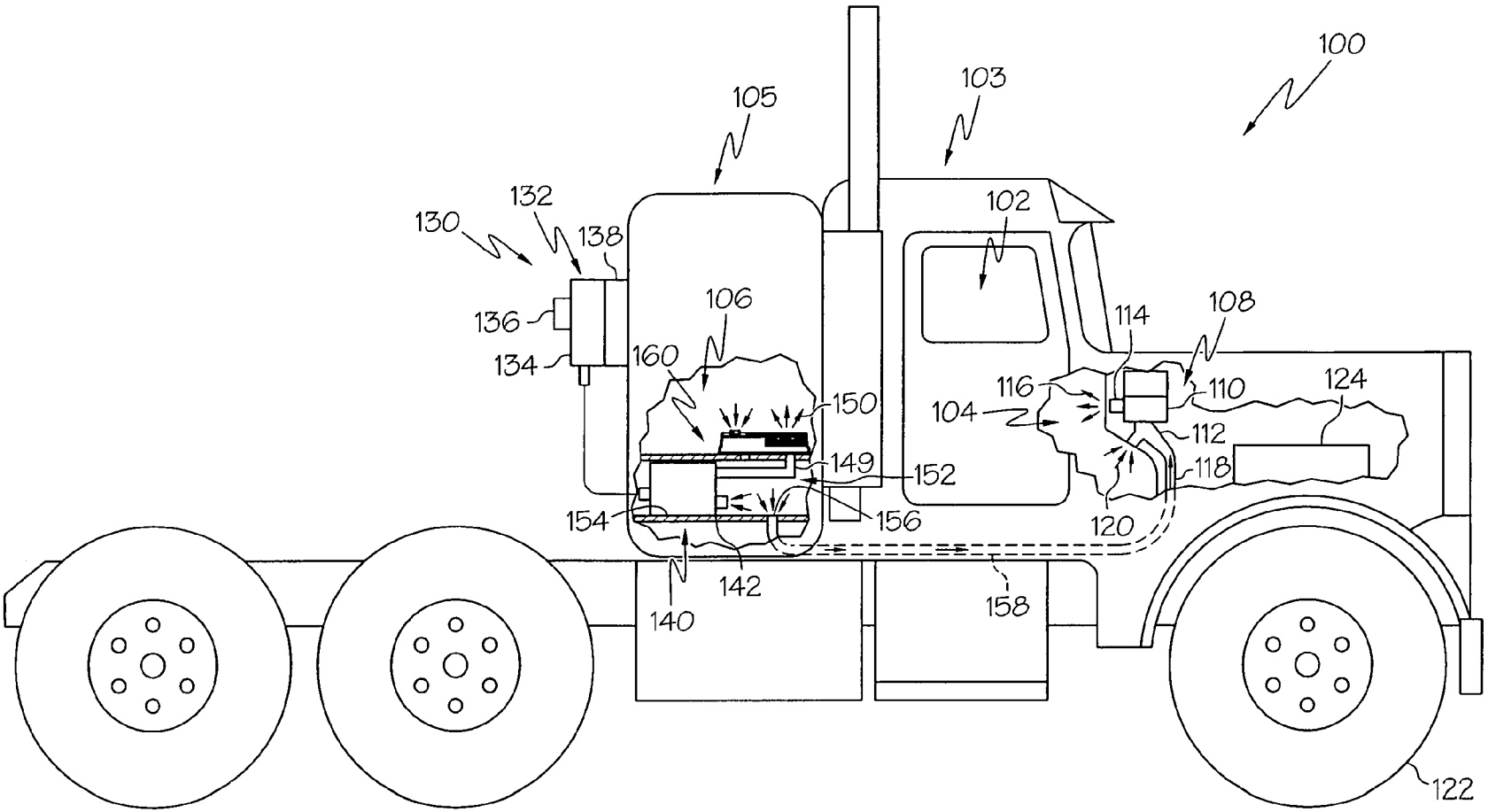
FIG. 4 is a front elevational view of an exemplary vehicle including a cover in accordance with the present invention with portions of-the vehicle shown broken away and certain elements shown in schematic form for clarity.

FIG. 4 depicts a vehicle 100 with portions broken away to depict features of an exemplary embodiment of the present invention. Further elements of the vehicle are shown in schematic form for clarity. The exemplary vehicle 100 can include interior compartments for distinct air conditioning systems. As shown, the vehicle 100 includes an interior area 102 with a driver compartment 104 and a sleeper compartment 106. In particular embodiments, the vehicle 100 might comprise a truck with a driver cab 103 including the driver compartment 104 and a sleeper cab 105 including the sleeper compartment 106. A wide range of vehicles, in addition to trucks, might comprise driver and sleeper compartments. For example, a vehicle might comprise a recreational vehicle wherein the driver compartment comprises the front seat area of the recreational vehicle and the sleeper compartment comprises a rear living area of the recreational vehicle. Vehicles might also comprise an automobile where the driver compartment comprises the front seat area and the sleeper compartment comprises a rear seat or rear area of the automobile. Other vehicles including a driver compartment and one or more additional compartments might also incorporate concepts of the present invention.

Figure 9:
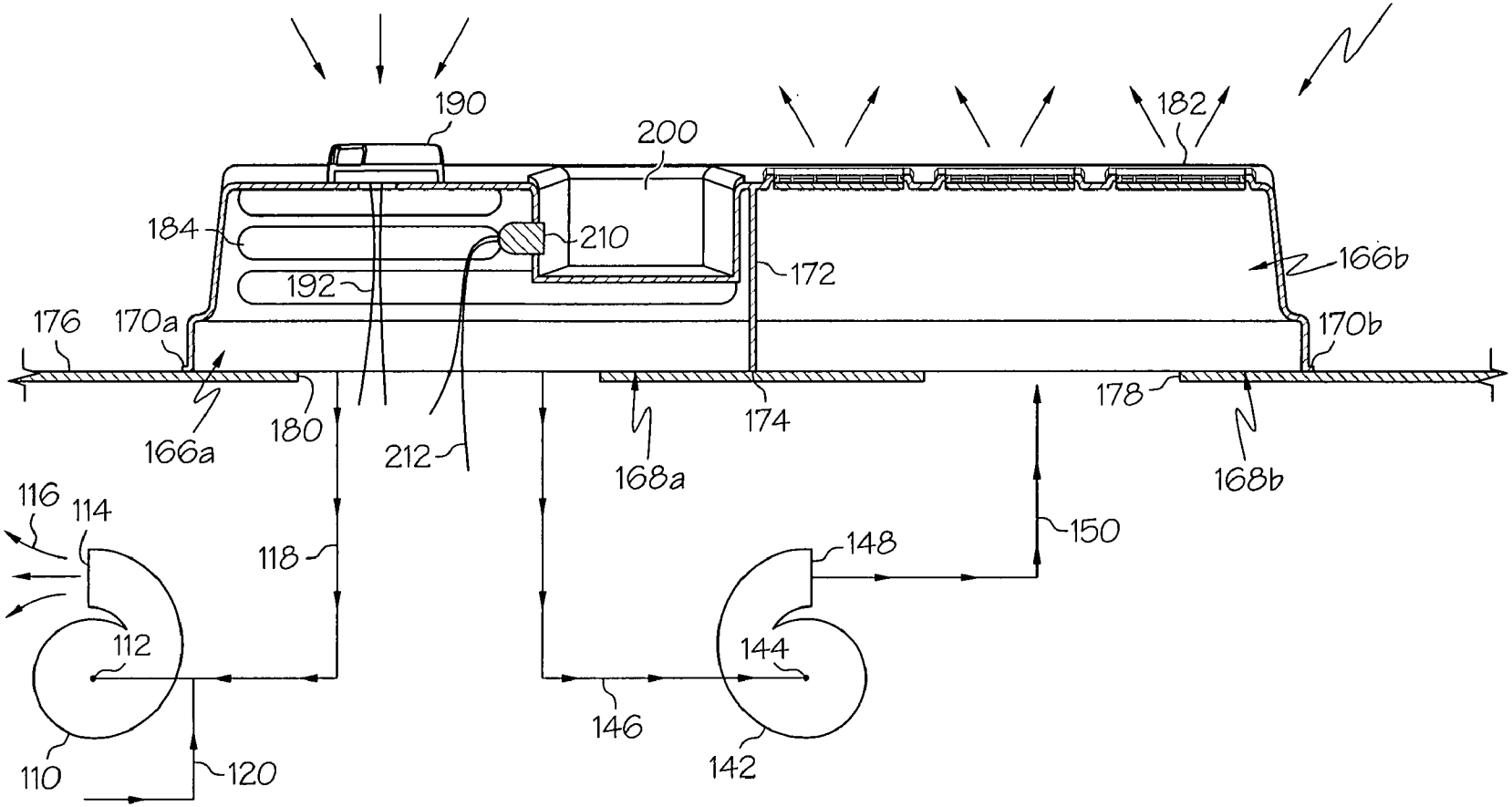
FIG. 9 is a sectional view of the cover along line 9—9 of FIG. 8, wherein the cover is illustrated in a mounted position with respect to a support surface and with a schematic arrangement of a first and second evaporator fan from a first and second air conditioning systems with respect to the cover are shown.

The vehicle 100 can include a first air conditioning system that can comprise a wide variety of systems. As shown in FIGS. 4 and 9, the first air conditioning system 108 comprises conventional components, such as an evaporator fan 110 including an air inlet 112 and an air outlet 114. The first air conditioning system 108 is adapted to condition (e.g., heat or cool) one or more air return streams such as a first air return stream 118 from the sleeper compartment 106 and a second air return stream 120 from the driver compartment 104. As shown, the conditioned air 116 is directed into the driver compartment 104. In embodiments where a closure (e.g., door, drapes, etc.) segregates the driver compartment 104 from the sleeper compartment 106, the first air conditioning system 108 might only or substantially be adapted to condition air in the driver compartment 104. In other examples, the first air conditioning system 108 might condition air in the sleeper compartment 106 in addition to the driver compartment 104. For instance, in the absence of a closure between the driver compartment 104 and sleeper compartment 106, conditioned air 116 may diffuse into the sleeper compartment 106 or there might be significant heat transfer between the sleeper compartment 106 and driver compartment 104.

The vehicle further includes an engine adapted to power a ground engaging wheel and the first air conditioning system. For example, as shown in partial schematic layout in FIG. 4, the exemplary vehicle 100 includes three pairs of ground engaging wheels 122 and an engine 124 adapted to power the first air conditioning system 108 and at least one of the ground engaging wheels 122. In additional embodiments, the vehicle 100 might power one or more pairs of the ground engaging wheels 122. While the illustrated engine 124 is adapted to power at least one wheel of a vehicle including six ground engaging wheels 122, aspects of the present invention may be employed with an engine that is adapted to power at least one wheel of a vehicle including one or more ground engaging wheels.

When traveling, the engine 124 is running to power the ground engaging wheels 122 and can also simultaneously power the first air conditioning system 108. In a parked condition, the vehicle engine 124 is not needed to power the ground engaging wheels 122 but must remain running for continued operation of the first air conditioning system 108. Idle running of a vehicle engine when the vehicle is parked can cause excessive wear and tear and can require undue fuel consumption that can present an environmental concern.

In order to provide comfort in the sleeper compartment 106, a second air conditioning system 130 is provided that, in certain embodiments, does not necessarily rely on the vehicle engine 124 for power. Accordingly, air in the sleeper compartment 106 may be conditioned without excessive fuel consumption and wear and tear of the vehicle engine 124 used to power the ground engaging wheels 122.

As shown in schematic form in FIGS. 4 and 9, in particular exemplary embodiments, the second air conditioning system 130 can be designed such that it is distinct from the first air conditioning system 108 in that the air conditioning systems do not include common parts. Therefore, in exemplary embodiments, no component of the first air conditioning system 108 is used to operate the second air conditioning system 130. Providing distinct air conditioning systems simplifies retrofit of existing vehicles to add a second air conditioning system for conditioning air at least in a sleeper compartment of the vehicle. Although not shown, the concepts of the present invention may also be employed with a second air conditioning system that is not distinct from a first air conditioning system.

In further exemplary embodiments, the second air conditioning system 130 can be designed such that it operates independently of the first air conditioning system 108. Therefore, the second air conditioning system 130 can be designed such that it functions without any input or assistance from the first air conditioning system 108. Independent operation of the air conditioning systems allows the second air conditioning system 130 to operate whether or not any part of the first air conditioning system 108 is functioning. In certain applications, independent operation provides advantages because one air conditioning system can be used without operating the other air conditioning system, thereby reducing power consumption and wear of components. Although not shown, the concepts of the present invention may also be employed with a second air conditioning system that does not operate independently from a first air conditioning system.

As shown schematically in FIGS. 4 and 9, the second air conditioning system 130 is adapted to direct air into the sleeper compartment 106. In applications where a closure (e.g., door, drapes, etc.) segregates the driver compartment 104 from the sleeper compartment 106, the second air conditioning system 130 might only condition air in the sleeper compartment 106. In other examples, the second air conditioning system 130 might condition air in the driver compartment 104 in addition to the sleeper compartment 106. For example, in the absence of a closure, conditioned air may diffuse into the driver compartment 104 or might cause heat transfer between the driver compartment 104 and sleeper compartment 106.

The second air conditioning system 130 can include a single assembly with at least one or all components mounted within or outside the interior area 102 of the vehicle 100. Although not necessary to practice the concepts of the present invention, it is also possible to provide a second air conditioning system including with certain components mounted outside the sleeper compartment and the remaining components mounted inside the sleeper compartment. For example, as shown in FIG. 4, the second air conditioning system 130 can include an exterior assembly 132 and an interior assembly 140. The exterior assembly 132 can be mounted to a location outside the interior area 102 of the vehicle 100. For example, as shown in FIG. 1, the exterior assembly 132 can be mounted to a rear side of the sleeper cab 105. Although not shown, further embodiments might include an exterior assembly 132 mounted to another side surface, a top surface or a bottom surface of the sleeper cab 105 or might be mounted at another location outside the interior area 102 of the vehicle 100. If provided, the exterior assembly 132 can comprise an auxiliary condenser coil assembly 134 and an auxiliary condenser fan 136. One or more offset brackets 138 may be provided to mount the auxiliary condenser coil assembly 134 and the auxiliary condenser fan 136 to a support surface. Still further, the interior assembly 140, if provided, can be mounted within driver compartment 104 or the sleeper compartment 106 of the interior area 102 of the vehicle 100. In one particular embodiment, the interior assembly 140 might be mounted underneath a bed located in the sleeper compartment 106. Certain elements of an exemplary interior assembly 140 are shown in schematic form in FIGS. 4 and 9. The interior assembly 140 includes an auxiliary compressor, an auxiliary evaporator coil and second evaporator fan 142. The second evaporator fan 142 includes an air inlet 144 adapted to receive air from an air return stream 146 and an air outlet 148 designed to deliver conditioned air 150 to the sleeper compartment 106.

In order to simplify installation, the interior and/or exterior assembly can comprise low loss quick connect inlet and outlet ports and low loss quick connect inlet and outlet lines. For example, a first low loss quick connect line can operably connect the low loss quick connect inlet port of the exterior assembly 130 with the low loss quick connect outlet port of the interior assembly 140. Similarly, the second low loss quick connect line can operably connect the low loss quick connect inlet port of the interior assembly 140 with the low loss quick connect outlet port of the exterior assembly 130.

Installation of the second air conditioning system 30 may be further simplified by providing the exterior and interior assembly as a kit with respective condenser and evaporator coils including precharged refrigerant fluid. Precharging the coils with refrigerant fluid reduces installation time and possible environmental spills during installation procedures. Prior to installation, the second air conditioning system may also be tested and optimized without requiring discharge of refrigerant material that might otherwise be necessary in applications that do not include precharged coils. Discharge of refrigerant material also requires additional preparation time and increases the likelihood of inadvertent leakage to the environment.

Figure 5:
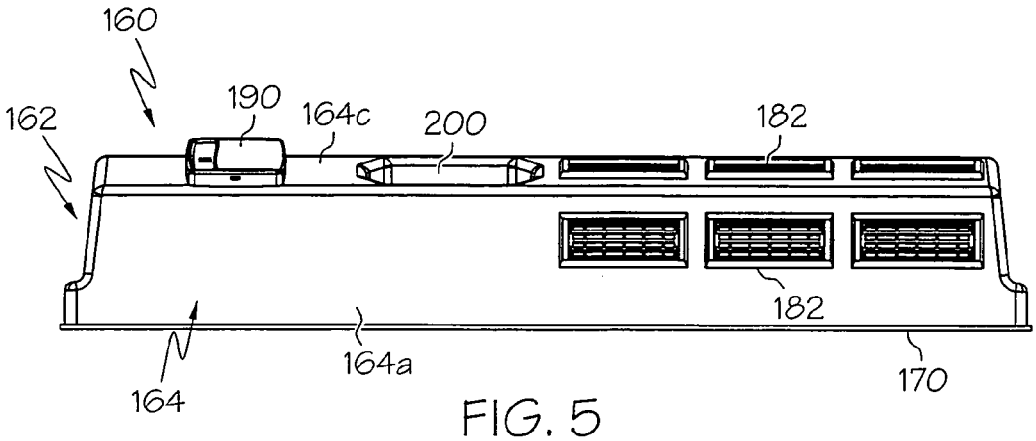
FIG. 5 is a front elevational view of a cover in accordance with an exemplary embodiment of the present invention.
Figure 6:
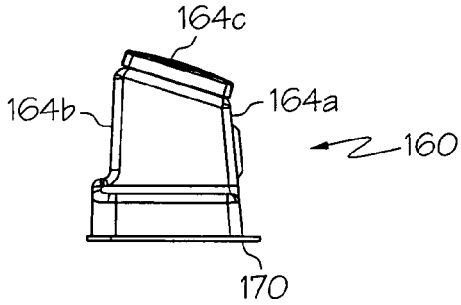
FIG. 6 is a left side elevational view of the cover of FIG. 5.
Figure 7:
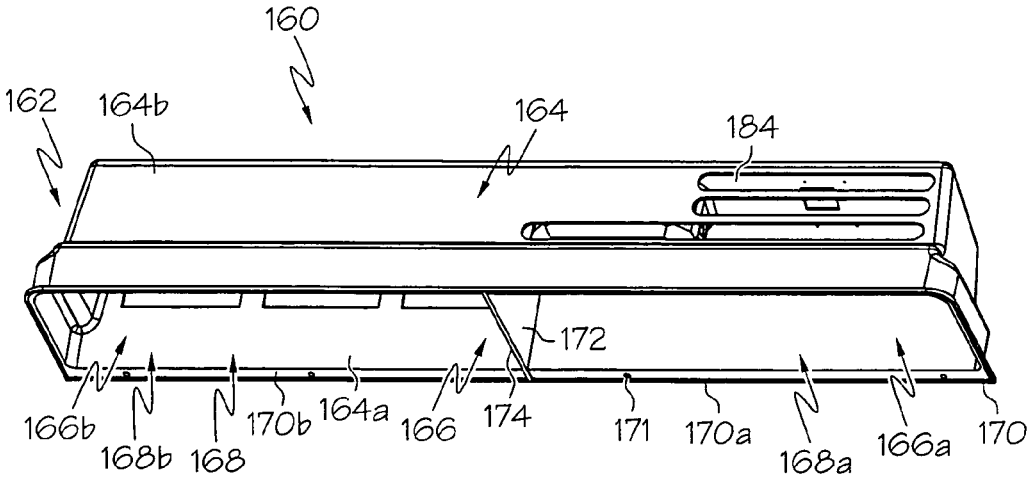
FIG. 7 is a lower perspective view of the body of the cover of FIG. 5.

An exemplary cover 160 in accordance with the present invention is illustrated in FIGS. 4–9. As shown in FIG. 7, the cover 160 includes a body 162 with a wall 164 defining an interior space 166. The wall includes a peripheral edge 170 defining an opening 168 to the interior space 166. The peripheral edge can comprise an end of the wall having a thickness approximately equal to the wall thickness. As shown, the peripheral edge may also comprise an outwardly extending lip including one or more openings 171 adapted to facilitate attachment of the cover 160 to a mounting surface of the vehicle 100. In exemplary embodiments, the peripheral edge 170 is adapted to substantially extend adjacent a substantially planar mounting surface 176. The body 162 can comprise a wide range of materials such as plastics (e.g., thermoplastics), composites, metal (e.g., aluminum, steel, etc.) or the like. For example, the outer shell of the body 162 can be vacuum formed from a thermoplastic material.

As further illustrated, the body 162 of the cover 160 might comprise a divider 172 designed to separate the interior space 166 into a first interior space portion **166*a* and a second interior space portion 166*b*. The divider 172 can also be designed to separate the opening 168 into a first area 168*a* in communication with the first interior space portion 166*a* and a second area 168*b* in communication with the second interior space portion 166*b*. For example, as shown in FIG. 9, separating the interior space 166 and the opening 168 with a divider may facilitate in at least partially preventing or inhibiting fluid communication between the first interior space portion 166*a* and the second interior space portion 166*b*. In the illustrated embodiment, the divider 172 includes a diver edge 174, wherein the divider edge 174 and a first portion 170*a* of the peripheral edge 170 define the first area 168*a* of the opening 168. The divider edge 174 and a second portion 170*b* of the peripheral edge 170 define the second area 168*b* of the opening 168. The divider edge 172 and the first and second portions 170*a*, 170*b* of the peripheral edge 170 are adapted to substantially extend adjacent the substantially planar mounting surface 176. This arrangement between the divider edge and the first and section portions of the peripheral edge helps prevent leakage at the interface between the mounting surface and the cover body, thereby at least partially preventing or inhibiting fluid communication between the interior space portions. Moreover, providing a gasket between the divider 172 and the mounting surface 176** may facilitate in at least substantially preventing or inhibiting fluid communication between the first and second space portions.

The cover 160 further includes a fluid inlet port 184 in fluid communication with the first interior space portion **166*a*. The fluid inlet port 184 is adapted to permit fluid located outside the interior space 166 to enter through the wall 164 and into the first interior space portion 166*a*. The fluid inlet port can comprise a wide variety of structures and components. For example, the fluid inlet port might comprise a device, such as plurality of rotatable vanes, adapted to regulate the fluid intake rate. In further embodiments, the fluid inlet port might simply comprise one or more openings through the wall of the body. For instance, as shown in FIGS. 7 and 9, the fluid inlet port 184 comprises a plurality of elongated parallel openings extending along a length of the first interior space portion 166*a***.

Figure 8:
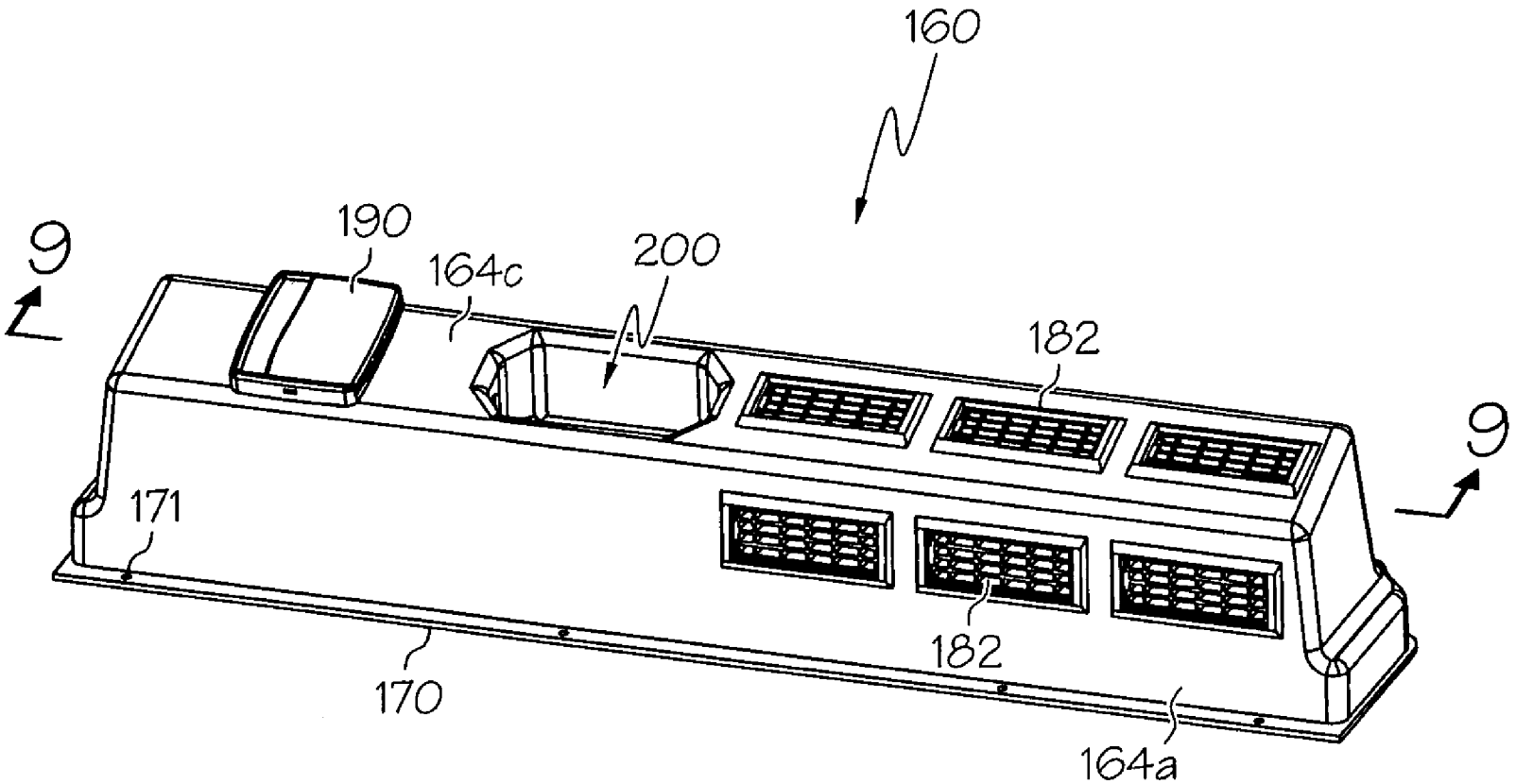
FIG. 8 is an upper perspective view of the cover of FIG. 5.

The cover 160 further includes a fluid outlet port 182 in fluid communication with the second interior space portion **166*b*. The fluid outlet port 182 is adapted to permit fluid located inside the second interior space portion 166*b* to exit through the wall 164 to a location outside the interior space 166. The fluid outlet port can also comprise various structures and/or components. For example, the fluid outlet port might simply comprise one or more openings through the wall of the body. The fluid outlet ports might also comprise one or more diffusing devices mounted within one or more openings defined in the wall 164. For example, as illustrated in FIGS. 5, 8 and 9, the fluid outlet port 182 comprises a plurality of diffusing devices that are each mounted in a respective one of a plurality of openings in the wall 164. The diffusing devices may facilitate air distribution from the second interior space portion 166*b***.

The fluid inlet and outlet port might also be provided at various locations to enhance functionality of the cover. The wall 164 of the cover 160 can include one or more wall portions to accommodated the fluid inlet and outlet ports. In the particular illustrated embodiment, the wall 164 includes a first wall portion **164*a* and a second wall portion 164*b* opposed from the first wall portion wherein the interior space 166 is substantially defined between the first and second wall portions. In exemplary embodiments, the fluid outlet port is located at least partially or entirely on the one of the first and second wall portions while the fluid inlet port is located at least partially or entirely on the other of the first and second wall portions. For example, as shown in FIGS. 5 and 7–9, the fluid outlet port 182 includes at least one port located on the first wall portion 164***a* that is adapted to permit fluid located inside the second interior space portion 166*b* to exit through the first wall portion 164*a* to a location outside the interior space 166. The fluid inlet port 184 can be located on the second wall portion 164*b* and can be adapted to permit fluid located outside the interior space 166 to enter through the second wall portion 164*b* and into the first interior space portion 166*a*. Providing portions of the fluid outlet and inlet ports on opposite walls of the cover can be beneficial to discourage fluid feedback into the fluid inlet port shortly after being disbursed from the fluid outlet port. Moreover, in certain applications, the cover may be mounted directly adjacent a bed in the sleeper compartment 106 with the first wall portion 164*a* generally facing the bed while the second wall portion 164*b* generally faces away from the bed. Mounting the cover in this manner positions the fluid outlet port 182 at least partially adjacent the bed to provide conditioned air toward the bed portion. Moreover, locating the fluid outlet port 182 adjacent the bed might tend to blow away adjacent bed sheets while the fluid inlet port 184 is located on an opposite side to minimize potential contact with sheets that can block the fluid inlet port with a vacuum-seal therebetween.

As further illustrated, the wall 164 can include a third wall portion 164*c* extending between the first wall portion 164*a* and the second wall portion 164*b*. It is contemplated that the fluid inlet or outlet port might, in addition or alternatively, be located on the third wall portion 164*c*. As shown, the fluid outlet port 182 comprises a plurality of fluid outlet ports wherein a least one of the plurality of fluid outlet ports is adapted to permit fluid located inside the second interior space portion 166*b* to exit through the first wall portion 164*a* to a location outside the interior space 166 and wherein at least another of the plurality of fluid outlet ports is adapted to permit fluid located inside the second interior space portion 166*b* to exit through the third wall portion 164*c* to a location outside the interior space. Providing the fluid outlet port 182 at the third wall portion 164*c* may facilitate directing air upward and into a central portion of the sleeper compartment 106. As shown in FIG. 6, the third wall portion 164*c* may also be inclined with respect to the first and second wall portions 164*a*, 164*b* to further facilitate directing air upward and into a central portion of the sleeper compartment 106.

The cover 160 can also include an optional digital control panel 190 mounted with respect to the body 162. The digital control panel may be adapted to control functions of the second air conditioning system 130 and can reduce time and installation costs of mounting a control panel separate from the cover 160. The digital control panel 190 includes at least one wire 192 operably connected to a location of the control panel and extending through the wall 164 and into the first interior space portion 166*a*. The wires 192 associated with the digital control panel 190 may also be threaded through an inlet aperture 180 of the mounting surface 176 as shown in FIG. 9. Therefore, an existing aperture (e.g., the inlet aperture) in the mounting surface may be used, thereby eliminating the need to cut a separate aperture to receive the control panel wires. Moreover, providing the cover 160 with the control panel 190 may allow a user to quickly locate the controls for the second air conditioning system. For example, in the dark, an individual in the sleeper compartment 106 can locate the fluid outlet port 182 of the cover 160 by sensing the source of the conditioned air stream being disbursed from the fluid outlet port 182. Once the cover 160 is located, the individual can quickly locate the digital control panel 190 that is also associated with the cover 160.

The cover 160 can also include one or more optional pockets adapted to function as a cup holder and/or adapted to contain miscellaneous items. The one or more pockets may alternatively function as a cigarette ash container or other waste container. As shown in FIGS. 5, 8 and 9, the cover includes a single pocket 200 but alternative embodiments might include a plurality of pockets with the same shape or alternative shapes to facilitate the intended function of each individual pocket. At least one pocket, if provided, might be provided with an electrical socket 210. The electrical socket 210 may include a cigarette lighter that can be removed to provide a power source for other electrical devices. The electrical socket 210 is mounted with respect to the body 162 with at least one wire 212 operably connected to a location of the electrical socket 210 and extending through the wall 164 and into the first interior space portion 166*a*. The wires 212 of the electrical socket 210 may also be threaded through the inlet aperture 180 of the mounting surface 176 as shown in FIG. 9. As with the digital control panel, an existing aperture (e.g., the inlet aperture) may be used, thereby eliminating the need to cut a separate aperture to receive the wires for mounting an electrical socket separate from the cover. Moreover, providing the electrical socket 210 adjacent a pocket 200 may be particularly beneficial when the pocket is designed to function as a cigarette ash disposal location.

An exemplary method of installing a second air conditioning system to a vehicle including a first air conditioning system will now be described. A second air conditioning system 130 is provided with a second evaporator fan 142. The second air conditioning system 130 is mounted with respect to a portion of the vehicle. A cover 160 is provided with a fluid inlet port 184 and a fluid outlet port 182. The cover 160 is mounted to a support surface 176 of the vehicle 100 such that the fluid outlet port 182 of the cover 160 is in fluid communication with the air outlet 148 of the second evaporator fan 142. The cover 160 is also mounted to the support surface 176 such that the fluid inlet port 184 of the cover 160 is in fluid communication with the air inlet 144 of the second evaporator fan 142. In further embodiments, the cover 160 may also be mounted such that the fluid inlet port 184 of the cover 160 is in fluid communication with the air inlet 112 of the first evaporator fan 110 in addition to the air inlet 144 of the second evaporator fan 142.

As described above, in certain embodiments, the second air conditioning system 130 may be provided in separate components. For example, the second air conditioning system 130 may be provided with the exterior assembly 132 including the condenser fan 136 and the condenser coil assembly 134. The interior assembly 140 may also be provided with the second evaporator fan 142, a compressor and an evaporator coil. The condenser coil and the evaporator coil of the second air conditioning system 130 can be precharged with refrigerant fluid prior to operable connections of the interior and exterior assemblies. The exterior assembly 132 may be mounted, for example, with the offset bracket 138 to a mounting surface of the vehicle. The interior assembly 140 may also be mounted with respect to the driver compartment 104 or the sleeper compartment 106 of the interior area 102 of the vehicle 100. Low loss quick connect lines may then be operably attached to respective low loss quick connect ports of the interior and exterior assemblies.

An exemplary method of retrofitting a vehicle with a first air conditioning system can also be carried out in accordance with aspects of the present invention. The method of retrofitting applies to a vehicle 100 including a first air conditioning system 108 with a first evaporator fan 110 including an air inlet 112 and an air outlet 114, a support surface 32, and a first cover 10 including a fluid inlet port 30 in fluid communication with the air inlet 112 of the first evaporator fan 110. The method comprises the steps of providing a second air conditioning system 130 with a second evaporator fan 142 with an air inlet 144 and an air outlet 148. The method further comprises the steps of providing a second cover 160 including a fluid inlet port 184 and a fluid outlet port 182. The first cover 10 is removed from the support surface and the second air conditioning system 130 is mounted with respect to a portion of the vehicle. Once the first cover 10 is removed from the support surface, the second cover 160 is mounted to the support surface such that the fluid outlet port 182 of the second cover 160 is in fluid communication with the air outlet 148 of the second evaporator fan 142 and the fluid inlet port 184 of the second cover 160 is in fluid communication with the air inlet 112 of the first evaporator fan 110 and the air inlet 144 of the second evaporator fan 142.

With particular reference to FIGS. 4 and 9, in use, the first air conditioning system 108 may be activated to provide conditioned air to at least the driver compartment 104 of the vehicle 100. The first evaporator fan 110 of the first air conditioning system 108 provides conditioned air 116 to at least the driver compartment 104 by way of the air outlet 114 of the first evaporator fan 110. The air inlet 112 of the first evaporator fan 110 can draw return air from the sleeper compartment 106 by way of the first air return stream 118 and/or can draw return air from the driver compartment 104 by way of the second air return stream 120. Although not shown, a valve may be provided to obtain return air from one or both of the driver compartment and the sleeper compartment. The return air stream 118 may comprise air drawn through the fluid inlet port 184, the first interior space portion 166*a*, the inlet aperture 180 of the mounting surface 176, a plenum 152 between the mounting surface 176 and a floor board 154, through an aperture 156 in the floor board 154, and through a conduit 158 in fluid communication with the air inlet 112 of the first evaporator fan 110.

The second air conditioning system 130 can also be activated to provide conditioned air to at least the sleeper compartment 106 of the vehicle 100. The second evaporator fan 142 of the second air conditioning system 130 provides conditioned air 150 to at least the sleeper compartment 106 by way of the air outlet 148 of the second evaporator fan 142. A conduit 149 may allow air to travel through the plenum 152 between an outlet aperture 178 defined in the mounting surface 176 and the air outlet 148 of the second evaporator fan. The air inlet 144 of the second evaporator fan 142 can draw return air from the sleeper compartment 106 by way of the air return stream 146. The return air stream 146 may comprise air drawn through the fluid inlet port 184, the first interior space portion 166*a*, the inlet aperture 180 of the mounting surface 176, the plenum 152 between the mounting surface 176 and the floor board 154, and thereafter into the air inlet 144 of the second evaporator fan 142. In exemplary embodiments, the conduit 158 might be provided with a check valve to prevent the return air stream 146 from drawing air through the conduit 158 when the first air conditioning system 108 is not in use.

From the above description of the invention, those skilled in the art will perceive improvements, changes and modifications. Such improvements, changes and modifications within the skill of the art are intended to be covered by the appended claims.

What is claimed:

1. A cover for an air conditioning system comprising:

a body including a wall defining an interior space, the wall including a peripheral edge defining an opening to the interior space;

a divider separating the interior space into a first interior space portion and a second interior space portion and separating the opening into a first area in communication with the first interior space portion and a second area in communication with the second interior space portion, the divider including a divider edge, wherein the divider edge and a first portion of the peripheral edge define the first area of the opening and the divider edge and a second portion of the peripheral edge define the second area of the opening, and wherein the divider edge and the first and second portions of the peripheral edge are adapted to substantially extend adjacent a substantially planar mounting surface;

a fluid inlet port in fluid communication with the first interior space portion and adapted to permit fluid located outside the interior space to enter through the wall and into the first interior space portion; and a fluid outlet port in fluid communication with the second interior space portion and adapted to permit fluid located inside the second interior space portion to exit through the wall to a location outside the interior space.

2. The cover of claim 1, wherein the wall includes a first wall portion and a second wall portion opposed from the first wall portion wherein the interior space is substantially defined between the first and second wall portions.

3. The cover of claim 2, wherein the fluid inlet port is adapted to permit fluid located outside the interior space to enter through the second wall portion and into the first interior space portion.

4. The cover of claim 2, wherein the fluid outlet port is adapted to permit fluid located inside the second interior space portion to exit through the first wall portion to a location outside the interior space.

5. The cover of claim 2, wherein the wall further includes a third wall portion extending between the first and second wall portions.

6. The cover of claim 5, wherein the fluid outlet port comprises a plurality of fluid outlet ports, wherein at least one of the plurality of fluid outlet ports is adapted to permit fluid located inside the second interior space portion to exit through the first wall portion to a location outside the interior space and wherein at least another of the plurality of fluid outlet ports is adapted to permit fluid located inside the second interior space portion to exit through the third wall portion to a location outside the interior space.

7. The cover of claim 6, wherein the fluid inlet port is adapted to permit fluid located outside the interior space to enter through the second wall portion and into the first interior space portion.

8. The cover of claim 1, further comprising a digital control panel mounted with respect to the body and including at least one wire operably connected to a location of the control panel and extending through the wall and into the interior space.

9. The cover of claim 1, wherein the wall of the body defines a pocket.

10. The cover of claim 1, wherein an electrical socket is mounted with respect to the body with at least one wire operably connected to a location of the electrical socket and extending through the wall and into the interior space.

11. A vehicle including the cover of claim 1, the vehicle comprising:

a first air conditioning system including a first evaporator fan with an air inlet and an air outlet; and a second air conditioning system including a second evaporator fan with an air inlet and an air outlet, wherein the second air conditioning system is distinct from the first air conditioning system and adapted to operate independently of the first air conditioning system, wherein the fluid inlet port of the cover is in fluid communication with the air inlet of the first evaporator fan and the air inlet of the second evaporator fan, and wherein the fluid outlet port of the cover is in fluid communication with the air outlet of the second evaporator fan.

12. The vehicle of claim 11, wherein the vehicle comprises an interior area including a driver compartment and a sleeper compartment, wherein the first air conditioning system is adapted to condition at least air in the driver compartment and the second air conditioning system is adapted to condition at least air in the sleeper compartment.

13. The vehicle of claim 12, wherein the cover is located in the sleeper compartment.

14. A method of retrofitting a vehicle to include a retrofit cover comprising the cover of claim 1, the method comprising the steps of:

providing a vehicle with a first air conditioning system including a first evaporator fan with an air inlet and an air outlet, a support surface, a first cover mounted to the support surface, and the first cover including a fluid inlet port in fluid communication with the air inlet of the first evaporator fan;

providing a second air conditioning system including a second evaporator fan with an air inlet and an air outlet;

removing the first cover from the support surface;

mounting the second air conditioning system with respect to a portion of the vehicle; and mounting the retrofit cover to the support surface such that the fluid outlet port of the retrofit cover is in fluid communication with the air outlet of the second evaporator fan and the fluid inlet port of the retrofit cover is in fluid communication with the air inlet of the first evaporator fan and the air inlet of the second evaporator fan.

* * * * *